United States Patent [19]

Kade et al.

[11] Patent Number: 4,865,692

[45] Date of Patent: Sep. 12, 1989

[54] STATIONARY SUPPORT MEMBER FOR WEB PRODUCING MACHINE

[75] Inventors: Werner Kade; Rudi Bück, both of Heidenheim; Bruno Freiler, Nattheim; Karl Wolf, Heidenheim-Schnaitheim, all of Fed. Rep. of Germany

[73] Assignee: J. M. Voith GmbH, Fed. Rep. of Germany

[21] Appl. No.: 306,288

[22] Filed: Feb. 2, 1989

Related U.S. Application Data

[63] Continuation of Ser. No. 82,080, Aug. 5, 1987, abandoned.

[30] Foreign Application Priority Data

Aug. 20, 1986 [DE] Fed. Rep. of Germany ..... 3628282

[51] Int. Cl.[4] ..... D21F 1/54

[52] U.S. Cl. ..... 162/352; 162/374

[58] Field of Search ..... 162/352, 354, 374

[56] References Cited

U.S. PATENT DOCUMENTS

| | | | |
|---|---|---|---|
| 3,027,940 | 4/1962 | Dunlap | 162/352 |
| 3,140,225 | 7/1964 | Truxa | 162/352 |
| 3,201,308 | 8/1965 | Goodard et al. | 162/352 |
| 3,497,420 | 2/1970 | Clark | 162/352 |
| 3,535,201 | 10/1970 | Reynolds et al. | 162/352 |
| 3,570,775 | 7/1970 | Truxa | 162/352 |
| 3,647,620 | 3/1972 | Truxa | 162/352 |
| 4,416,731 | 11/1983 | Personen et al. | 162/352 |

FOREIGN PATENT DOCUMENTS

| | | | |
|---|---|---|---|
| 894552 | 3/1972 | Canada . | |
| 0080447 | 6/1983 | European Pat. Off. . | |
| 2510492 | 9/1976 | Fed. Rep. of Germany | 162/352 |
| 7807296 | 7/1979 | Fed. Rep. of Germany . | |
| 601554 | 7/1978 | Switzerland . | |

*Primary Examiner*—Karen Hastings

*Attorney, Agent, or Firm*—Ostrolenk, Faber, Gerb & Soffen

[57] ABSTRACT

The invention relates to a stationary supporting member for the drainage wire belt of a paper machine. The supporting member has a transverse head board with a doctor-like leading edge which contacts the underside of the wire belt. The head board is formed from hard material, which has a drainage area forming a small, variable angle of inclination with the direction of travel of the wire belt. Two C-beams support the head board, one secured rigidly in the machine and the other, which carries the head board, being hinged to the rigid beam. An adjusting board on the rigid beam and having several adjustable stop surfaces distributed over its length, engages stops on which the movable beam is supported. The two beams are clamped together by means of an inflatable hose between the arms of the beam.

20 Claims, 3 Drawing Sheets

STATIONARY SUPPORT MEMBER FOR WEB PRODUCING MACHINE

This is a continuation of Application Ser. No. 07/082,080 filed on Aug. 5, 1987 now abandoned.

BACKGROUND OF THE INVENTION:

The present invention relates to the forming or wire section of a machine for producing a web of paper, or the like from a fibrous stock suspension and more particularly to a stationary support member for the endless drainage wire belt.

Stationary supporting members are used for support of the endless wire belt on which a fibrous stock web is formed from the fibrous suspension flowing continuously onto the wire belt. In addition, the doctor-like leading edge of the head board of the supporting member is also used to carry away the white water which has flowed out of the forming fibrous stock web through the meshes of the wire belt and clings to the underside of the wire belt. At the same time, due to the inclination of the drainage area of the head board relative to the direction of travel of the wire on the underside of the endless wire belt, a vacuum is generated which intensifies drainage. The intensity of this drainage depends on the size of the angle of inclination of the drainage area.

In paper machines on which the operating conditions change frequently, for example, changes of paper grade, operating speed, etc., a variation of that angle of inclination at the stationary supporting members is frequently necessary. For this reason, a reliable design has for a long time been sought for the adjustment of the angle of inclination. The following publications describe such designs:

1. U.S. Pat. No. 2,928,465
2. U.S. Pat. No. 3,027,940
3. U.S. Pat. No. 3,201,308
4. U.S. Pat. No. 3,337,236
5. U.S. Pat. No. 3,497,420
6. U.S. Pat. No. 3,520,775
7. U.S. Pat. No. 3,535,201
8. U.S. Pat. No. 3,647,620
9. DE-OS No. 25 10 492
10. DE-GM No. 78 07 296
11. CH-PS No. 601 554
12. EP-OS No. 00 80 447

There are many reasons that, in practice, nonadjustable stationary supporting members are used almost exclusively. If it is desired to vary the angle of inclination of the drainage area on these nonadjustable supporting members, the head board must be removed from the supporting member and thus from the paper machine, and must be replaced by another head board with a different angle of inclination. This method is unsatisfactory, because it is very dangerous to carry out such a head board change while the paper machine is running. Furthermore, it necessitates the exchangeability of the head board of such a nonadjustable supporting member so that the head board rests on the supporting member with a certain clearance. This clearance may be the cause of undesired changes in the angle of inclination of the drainage area.

On many of the well-known supporting members with an adjustable angle of inclination, there is the risk that the supporting member will tend to vibrate, precisely because of the adjustability of the angle of inclination of the drainage area. The vibrations also caused by this in the wire belt disturb the uniform drainage of the fibrous stock web. This danger exists above all when the entire supporting member can be swivelled to vary its angle of inclination, that is, it rests in swivel supports at both its ends, i.e. on the tending and drive sides of the paper machine. A further difficulty consists in keeping the adjusting member for the angle of inclination of the drainage area free from contamination. This is important because the adjusting member becomes, on the one hand, difficult to move as a result of contamination and, on the other hand, the required angle of inclination cannot be set with the desired accuracy and reproducibility.

Many of the well-known designs have the disadvantage that they require a great deal of space, so that it is not possible to make the distance between two consecutive supporting members as small as would be necessary to achieve optimum drainage. This applies particularly to modern paper machines of large width (the order of 6–10 m).

In the case of a number of other well-known designs, the head board contacting the underside of the wire belt is not made of a stiff, hard material, but instead is made of a flexible, deformable material. This enables the change in the angle of inclination of the drainage area to be made by deforming the head board. Practice has, however, shown that only a head board constructed as a completely rigid body (made of ceramic or a similar hard material) ensures the required high service life and stability of shape. Flexible deformability of the head board has the additional disadvantage that the drainage area is not substantially flat, but becomes at least in part, rounded. Observations have shown that this produces non-uniform drainage across the width of the paper machine, in a similar way to the support of the wire by means of table rolls.

The above-mentioned publication No. 2; U.S. Pat. No. 3,027,940, describes a stationary supporting member with a deformable head board. FIGS. 6 to 8 therein disclose a supporting structure for the head board, which comprises two beams with C-shaped cross-section extending transversely across the machine width, namely a C-beam secured rigidly in the machine and a movable C-beam. Viewed in cross-section, the arms of the two C-beams engage in each other so that the top arm of the rigid C-beam is located between the arms of the movable C-beam and, consequently, the bottom arm of the movable C-beam is between the arms of the rigid C-beam. The movable C-beam is coupled to the rigid C-beam by means of a hinge element which is formed as a spring plate. Furthermore, several adjustable stops distributed over the length of the supporting member are fitted to the rigid C-beam, on which the movable C-beam can be supported against the rigid C-beam. Finally, a clamping element formed as an inflatable hose is provided between the top arm of the rigid C-beam and the bottom arm of the movable C-beam. The supply of a pressure means to this hose, to deform the head board by a certain dimension, can press the movable C-beam onto the stop surfaces and thereby clamp the two C-beams with each other. The head board is secured at its front end (i.e. near the leading edge contacting the wire belt) to the C-beam by means of a hinge. At its rear end, the head board is secured to the rear end of the above-mentioned spring plate. This kind of fastening has the disadvantage that the rear end of the head board can swing up and down.

A further disadvantage of the well-known design is that the large number of stops, which are formed as bolts distributed over the length of the supporting member, have to be adjusted individually if the angle of inclination of the drainage area is to be varied. It is therefore very difficult or perhaps even impossible to set a selected definite and certain angle of inclination with the desired accuracy while the paper machine is running. On the whole, however, the use of this well-known design is ruled out in practice, because, as already mentioned, the head board is deformable instead of rigid and thus the drainage area is rounded (with a variable radius of curvature) instead of being substantially flat.

In contrast to U.S. Pat. No. 3,027,940, No. 8, U.S. Pat. No. 3,647,620 discloses a stationary supporting member on which the head board is formed as a rigid body with a flat drainage area and is rigidly connected to a movable beam. Furthermore, there is a beam that is rigidly secured in the machine. All these three elements extend across the entire paper machine transversely of the direction of wire travel. The movable beam and the head board can be jointly swivelled because they are coupled to the rigid beam by means of a spring plate which forms a hinge. The spring plate can extend substantially over the entire length of the supporting member or be subdivided into individual sections.

This well-known design has the following disadvantages. The pairs of stop surfaces used to adjust the angle of inclination are formed by spigots 17, which engage in oblique oblong holes of an adjusting board that is slidable in the longitudinal direction. Since there must always be a certain, even if small, clearance between the side walls of the oblong holes and those spigots, this well-known adjusting member necessarily has a certain hysteresis. Furthermore, because of this clearance, vibrations of the head board and of the supporting board relative to the rigid beam, and undesired variations in the angle of inclination of the drainage area, can be expected. Finally, the adjusting unit is arranged unprotected at the rear side of the supporting member, so there is the risk of the above-mentioned danger of contamination.

SUMMARY OF THE INVENTION

The object of the invention is to create a stationary supporting member for an endless drainage wire belt in which the angle of inclination of the drainage area is variable and which also meets the following requirements.

(a) The head board should be non-deformable and have an (at least predominantly) flat drainage area.

(b) The angle of inclination of the drainage area relative to the direction of wire travel should be mechanically variable at any time during operation of the paper machine so that a certain angle of inclination can be set by means of an external control. At the same time, a certain angle of inclination should be reproducible with high accuracy; i.e. from a certain position of the adjusting unit, there should always be the same angle of inclination, even under changed operating conditions.

(c) Despite the necessary movability of the head board, the hinge, the adjusting unit for the angle of inclination and all connections should be completely free from clearance. This precludes the risk of vibrations and the already mentioned accuracy of the setting of the angle of inclination should be increased.

(d) The width of the supporting member, measured in the direction of wire travel, should be as small as possible so that many units can be arranged consecutively in a restricted space.

This problem is solved by the combination of the following features. These features are individually taken from different known designs but are arranged in a novel combination.

1. Two C-beams extend transversely through the machine. One beam is secured rigidly in the machine. Only the other movable beam supports the head board. That board is made of a non-flexible, hard material. The movable C-beam and the head board are therefore coupled rigidly to each other and only move together to vary the angle of inclination of the substantially flat drainage area. This reduces the risk of vibrations and the number of areas where clearances can occur.

2. The arms of the two C-beams engage in each other. They are, on the one hand, connected to each other by means of a hinge. On the other hand, they are pressed onto each other by means of a clamping element, e.g. an inflatable hose, at pairs of adjustable stop surfaces. These features, too, make a substantial contribution to keeping the supporting member according to the invention free from clearance and preventing it from vibrating.

3. The hinge connecting the two C-beams extends, with at most short interruptions, over the entire length of the supporting member. In exactly the same way, a full-length adjusting board is planned for the formation of as large a number of pairs of adjustable stop surfaces as possible distributed over the length. These features permit connection of the movable C-beam supporting the head board substantially over the entire length of the supporting member to the bottom, rigid C-beam. By this means, the forces exerted on the head board during operation of the paper machine from the wire belt and from the white water flow which is deflected at the trailing edge of the head board are transmitted uniformly to the bottom, rigid C-beam. This prevents the movable C-beam from undergoing substantial deflections together with the head board, so that there is no risk of possible destruction of the head board, as this board, after all, may be made wholly or partly of a very sensitive, brittle, hard material, e.g. ceramic.

Furthermore, it has been recognized that the known use of two C-beams engaging in each other permits various advantageous designs:

1. The adjusting board and the clamping element (e.g. hose) can be arranged one above the other so that there is a small width dimension for the supporting member (in the direction of wire travel). Hence, numerous supporting members according to the invention can be accommodated one after the other in a restricted space.

2. The adjusting board can be arranged in numerous embodiments of the invention in the interior of the supporting member, that is, it may be protected against external influences which might cause contamination.

3. According to a further feature of the invention, the hinge element, preferably in the form of a spring plate, can be secured in the area underneath the leading edge of the head board to the rigid C-beam and can be shifted in the direction of wire travel to the top arm of the movable C-beam. Diverging from the embodiments described in U.S. Pat. No. 3,647,620, this ensures that the hinge element is always under tensile stress during operation of the paper machine. The previously mentioned forces which the wire belt and the white water flow exert on the head board act predominantly in the direction of wire travel. The tensile stress prevailing in the hinge element causes the connecting point between the hinge element and the C-beams to be kept free from clearance, i.e. any existing clearance is made harmless. In addition, should the hinge be formed as a spring plate, a relatively large distance can be planned, as viewed in cross-section, between the two securing points. Due to this, the force exerted for adjustment of the angle of inclination is much smaller than that required when there is a small distance between the securing points. The large distance, however, as already mentioned, presupposes that tensile forces prevail in the spring plate. If, on the other hand, the spring plate were subjected to compression forces, there would be the risk of the spring plate buckling.

Further advantageous configurations of the invention and various embodiments are explained below with reference to the accompanying drawings.

DETAILED DESCRIPTION OF THE PREFERRED EMBODIMENTS

Figure 1:
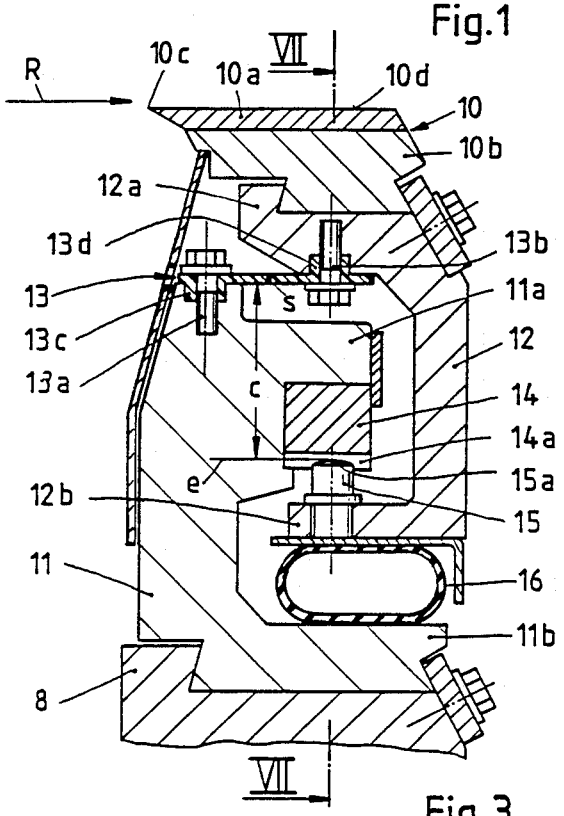
FIGS. 1 to 6 each show a cross-section through differently formed stationary supporting members according to the invention.
Figure 7:
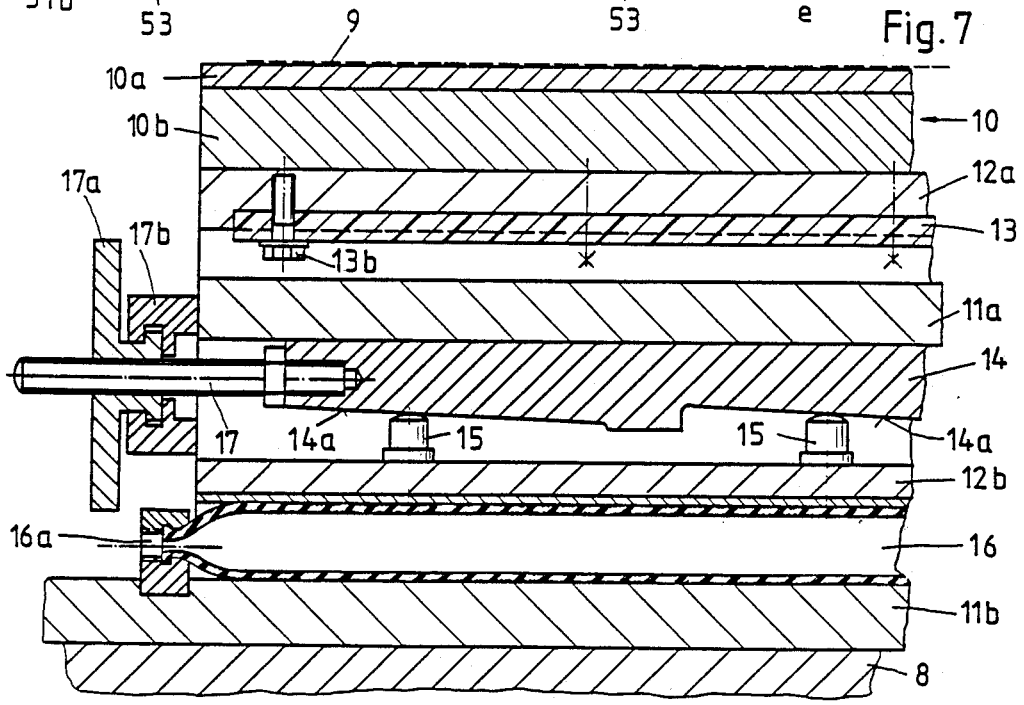
FIG. 7 shows a partial longitudinal section view taken at line VII—VII of FIG. 1.

The stationary supporting member shown in FIGS. 1 and 7 has a head board 10, which is rigidly connected to a movable beam 12. This movable beam 12 has a substantially C-shaped cross section. A non-movable beam 11 which likewise has a C-shaped cross-section, is rigidly connected to a machine frame or to the top side of box 8, which in turn rests, for example, on the longitudinal beams of the paper machine.

The head board 10 can, according to FIG. 1, be comprised of ceramic pieces and comprises one top portion 10*a* and of one bottom portion 10*b*. It can, however, also be formed in one piece or, viewed in cross-section, it can be comprised of single-piece sections of hard material. In any event, the head board has a doctor-like projecting, leading edge 10*c* for contacting the underside of a wire belt 9 (see FIG. 5) and has a flat drainage area 10*d*, which is at a small, variable angle of inclination a (see FIG. 5) with the direction of travel R of the wire belt. A completely flat drainage area 10*d* is provided, which directly adjoins the leading edge 10*c*. At variance with this, starting from leading edge 10*c* a short, slightly curved wire supporting surface or a short, flat screen supporting surface, which is substantially parallel to the direction of wire travel, can first of all be provided. The inclined, flat drainage area in each case adjoins the wire supporting surface. In all Figures it is assumed that the direction of travel R of the wire belt 9 is horizontal. However, the direction of wire travel may also be inclined or vertical.

Figure 5:
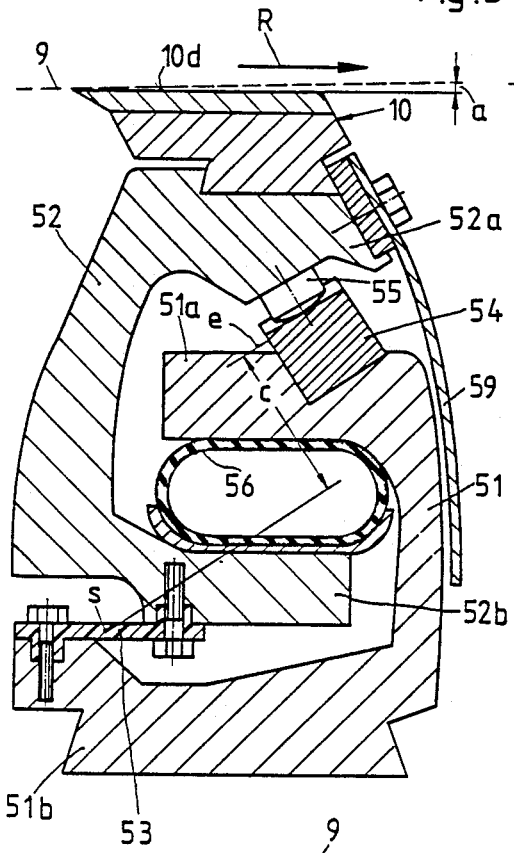
Figure 6:
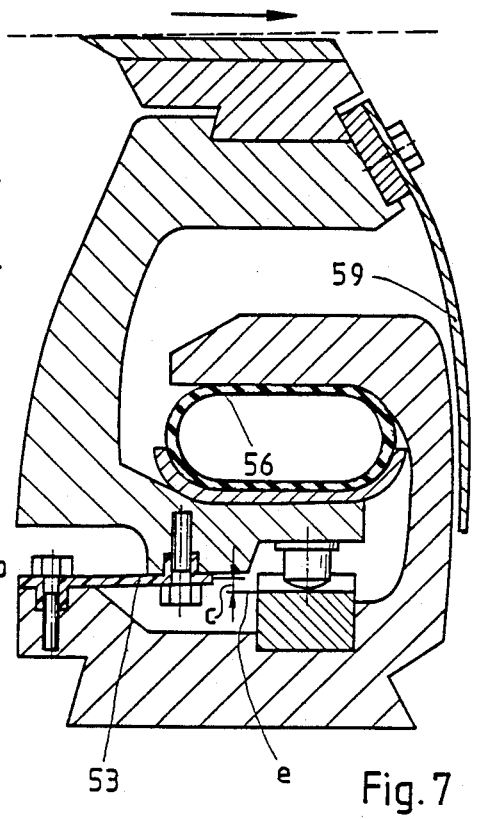

The arms 11*a* and 11*b* of the rigid beam 11 extend in the direction R of wire travel, while the arms 12*a* and 12*b* of the movable C-beam extend in the opposite direction. This applies to the embodiments according to FIGS. 1 to 4. In FIGS. 5 and 6, on the other hand, the reverse arrangement has been made. In all cases the two C-beams 11 and 12, viewed in cross-section, engage into each other with their arms 11*a* , 11*b* and 12*a*, 12*b* arranged in such a way that the top arm 11*a* of the rigid C-beam 11 is located between the arms 12*a* and 12*b* of the movable C-beam.

Although FIG. 7 shows only a detail longitudinal section through the supporting member, namely at one of the two ends, it is self-evident that the head board 10 and the two C-beams 11 and 12 extend across the entire width of the paper machine so that the wire belt 9 is supported over its entire width by the stationary supporting member.

The movable C-beam 12 is coupled to the rigid C-beam 11 by means of a hinge element 13 which likewise substantially extends across the entire width of the machine. Should the hinge element 13 be subdivided into several individual portions, to facilitate its manufacture, for example, only short distances are planned between the individual portions. In the embodiments shown, the hinge element 13 is formed as a spring plate. Among other things, the actual hinge in the area of the hinge axis is completely free from clearance. However, hinge elements of a different type, e.g. hinges free as far as possible from clearance, or the like, can also be used.

In any event, however, the following measures have proven to be particularly advantageous: As can be seen from FIGS. 1 to 4, the hinge element 13 is secured on the one hand in the area underneath the leading edge 10*c* of the head board 10 to the rigid C-beam 11, by means of a large number of bolts 13*a* distributed over the length of the C-beam. On the other hand, the hinge element 13 is secured to the underside of the top arm 12*a* of the movable C-beam 12, likewise by means of a large number of bolts 13*b*. The row of bolts 13*b* are shifted in the direction R of the wire travel from the other row of bolts 13*a*. This ensures that the hinge element 13 is always under tensile stress in the direction R of wire travel during operation of the paper machine, because of the forces already mentioned above. To make the securing points of the hinge element 13 to the C-beams 11 and 12 also as free as possible from clearance, the hinge element 13 engages with a respective projection 13*c* or 13*d* into a recess (e.g. a slot) machined into each C-beam.

As can be seen in FIGS. 1 to 6, the hinge element 13, viewed in the cross-section, extends preferably parallel to the direction of travel R of the wire belt 9. However, a divergence can also be made from this arrangement. It is, for example, possible for the distance between the wire belt 9 and the hinge element 13 underneath the leading edge 10*c*, i.e. in the area of the bolts 13*a*, to be smaller than at the other end, i.e. in the area of the bolts 13*b*.

In the area between the top arm 11*a* of the rigid C-beam 11 and the bottom arm 12*b* of the movable C-beam 12 there are, according to FIGS. 1 and 7, a plurality of pairs of adjustable stop surfaces 14*a*, 15*a* distributed over the length of the supporting member. An adjusting board 14 controls these adjustable stop surfaces 14 as the board 14 extends longitudinally through the entire supporting member and is slidable over this longitudinal extension, being guided by the rigid C-beam 11. The adjusting board 14 preferably has a rectangular cross-section. In FIGS. 1 and 7, the underside of the board 14 has a number of identical stop surfaces 14*a* that are inclined against the direction of travel.

Each of these stop surfaces 14a opposes a respective pin 15. These pins rest on the top side of the bottom arm 12b of the movable C-beam 12. The top end face 15a of each pin is slightly rounded and is in contact with the surface 14a.

To ensure this contact at all pairs of contact surfaces 14a, 15a, in FIGS. 1 and 7 a clamping element is used between the two bottom arms 11b and 12b of the two C-beams 11 and 12 in the form of an inflatable hose 16. This hose is closed at one end (not visible in the drawing) and is fitted with a pipe connection 16a at its other end (see FIG. 7). Hence the interior of the hose can be pressurized with a pressure medium, preferably water. Although the hose 16 is the most appropriate embodiment for the clamping element, other clamping elements can also be used. One example is a clamping board equipped with a plurality of inclined surfaces located one after the other, which is thus formed in a similar way to the adjusting board 14.

For forming the pairs of stop surfaces 14a and 15a, other design possibilities are conceivable besides the adjusting board 14 shown in FIGS. 1 to 7, which, as mentioned, is slidable in the longitudinal direction. Instead of such a board, a shaft mounted to rotate in the rigid C-beam 11 could extend longitudinally through the entire supporting member. This shaft may have a plurality of eccentric collars or cams distributed over its length, which would contact corresponding stop surfaces of the movable C-beam 12.

For longitudinally sliding the adjusting board 14, a threaded spindle 17 is rigidly connected to one end thereof, as shown in FIG. 7. A drive disk 17a is on spindle 17. Disk 17a has a corresponding female thread and is axially fixed in the radial direction by means of an axial bearing 17b secured to the rigid C-beam 11. To slide the adjusting board 14, the drive disk 17a can, if required, be turned by hand or by means of a motor, which is not shown. The motor can be controlled by means of an electric control unit. In this case, sliding of the adjusting board can be triggered either by actuation of an electric switch or automatically on the basis of selected measuring signals. The control unit can be formed so that during sliding of the adjusting board 14, the pressure in the hose 16 is automatically lowered by a predetermined amount. This reduces the adjusting force required for sliding the board 14.

It can now be understood with reference to FIG. 1 that longitudinal sliding of the adjusting board 14 triggers swivelling of the movable C-beam 12, including the head board 10 and the pin 15 supported on the beam 12, about the swivel axis S located approximately in the center between the rows of bolts 13a and 13b. By means of such a swivelling movement the angle of inclination a of the drainage area 10d changes (FIG. 5). With such a swivelling movement, the pins 15, viewed in cross-section in FIG. 1, move relative to the adjusting board 14 by a predetermined distance to the side (toward the right or toward the left, depending on the direction of adjustment). This sideward movement of the pins 15 generally has no disturbing effect.

Figure 2:
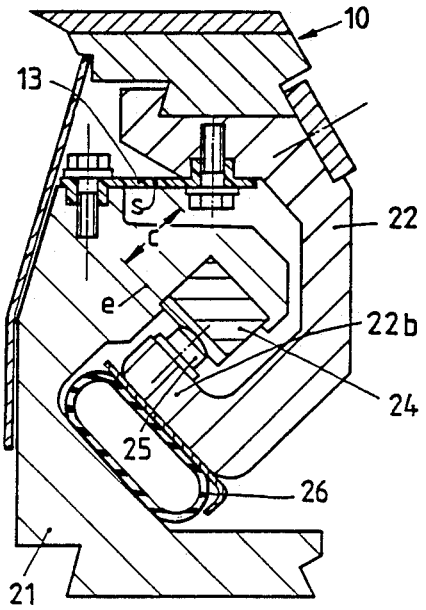

If it is nevertheless desired to avoid this sideward movement (or at least to reduce it in extent), then it is possible, in accordance with FIG. 2, to arrange the bottom arm 22b of the movable C-beam 22 together with the pin 25 and, in exactly the same way, the adjusting board 24 and the clamping element (again formed as hose 26) at an angle, and to adapt the shape of the rigid C-beam 21 accordingly. In this way, the distance c between the swivel axis S and the pairs of stop surfaces is made to be much smaller than with the arrangement according to FIG. 1. The smaller this distance c, the smaller the sideward movement of the pins 25 relative to the adjusting board 24. In other words, the plane e determined by the pairs of stop surfaces should run as close as possible to the swivel axis S.

Figure 3:
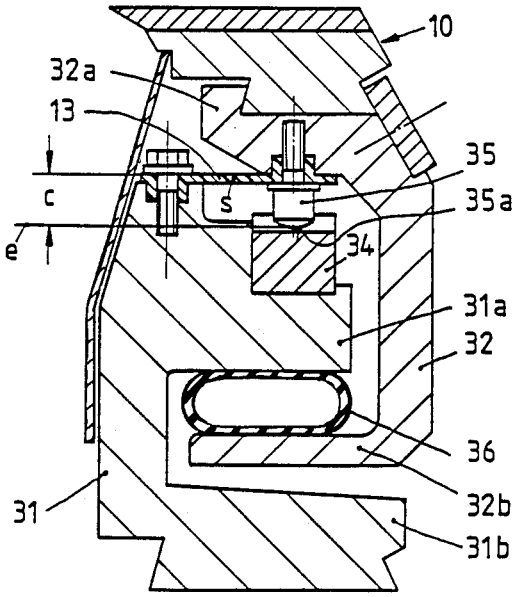

The aforementioned distance c with the arrangement according to FIG. 3 is even smaller than in FIG. 2. This differs from the embodiments of FIGS. 1 and 2 in that the adjusting board 34 is now arranged between the two top arms 31a and 32a of the C-beams 31 and 32. This forms the stop surfaces 35a of the movable C-beam 32 by pins 35 which are at the same time used for bolting the spring plate 13 to the movable C-beam 32. The clamping element (hose 36) is in this case arranged between the top arm 31a of the rigid C-beam 31 and the bottom arm 32b of the movable C-beam 32.

Figure 4:
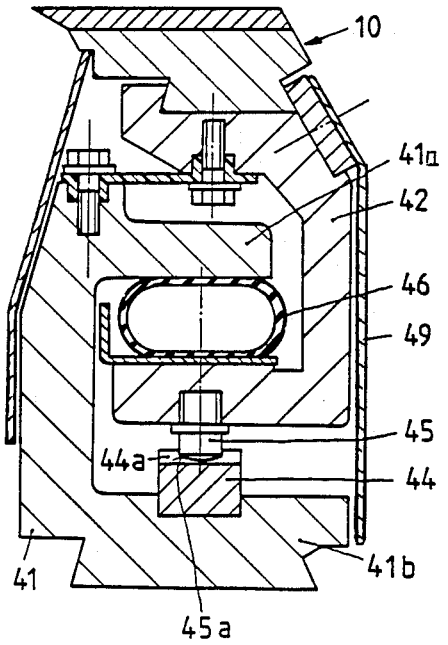

The example shown in FIG. 4 differs from FIG. 1 substantially only in that, on the one hand, the adjusting board 44 and the associated pins 45 and, on the other hand, the clamping element 46 in the form of a hose, have exchanged places. The adjusting board 44 is now guided on the bottom 41b of the rigid C-beam 41. Consequently, the pins 45 are arranged on the underside of the bottom arm 42b of the movable C-beam 42. The hose 46 is now located between the top arm 41a of the rigid C-beam 41 and the bottom arm 42b of the movable C-beam 42. The center lines of the pins 45 are arranged in FIG. 4 as precisely as possible in the center of the hose 46. This prevents the hose 46 from exerting a bending moment on the movable C-beam 42. In the same way, it can also be ensured in the embodiments according to FIGS. 1–3 and 6 that the force generated by the hose runs through the axes of the pins.

A disadvantage of the arrangement according to FIG. 4 is that the stop surfaces 44a and 45a must be protected against contamination by an additional guard 49 which is secured to the rear side of the supporting member at the movable C-beam 42. An advantage of the embodiment of to FIG. 4, and incidentally also of the embodiment of FIG. 3, consists in that the forces exerted during operation of the paper machine, by the running wire belt and by the white water flow which is deflected down at the leading edge of head board 10, on the head board and on movable C-beam 42, are transmitted via the pairs of stop surfaces 44a and 45a directly to the rigid C-beam 41. Therefore, the pressing force exerted on the pair of stop surfaces by the clamping element 46 is increased still further by the forces created during operation. In FIG. 1, on the other hand, the pressing forces exerted by the clamping element 16 are reduced by the forces created during operation.

The cross-sections of FIGS. 1–4 show that the stationary supporting member according to the invention takes up relatively little space in the direction R of wire travel, so that, if required, several supporting members can be arranged one after the other in a relatively restricted space.

In FIGS. 5 and 6 the C-beams are arranged to face the opposite way from the C-beam in FIGS. 1–4. For instance, the arms 52a and 52b of the movable C-beam 52 extend in the direction R of wire travel and the arms 51a and 51b of the rigid C-beam 51 in the opposite direction. The hinge elements 53 are now, on the one hand, secured to the bottom arm 51b of the rigid C-beam 51 and, on the other hand, again shifted in the direction R of wire travel, to the underside of the bottom arm 52b of the movable C-beam 52, and thereby differing from FIGS. 1–In FIG. 5, the adjusting board 54 is mounted on the top side of the top arm 51*a* of the rigid beam 51. Accordingly, the pins 55 contacting the adjusting board are secured to the underside of the top arm 52*a* of the movable C-beam 52. The adjusting board 54 and the pins 55 are arranged in an inclined position, similar to the way shown in FIG. 2, such that there is a somewhat reduced distance C between the hinge axis of the stop surfaces and the adjusting board 54, compared to the distance which would arise if the pins 55 and the adjusting board 54 were arranged exactly vertically one above the other. The clamping element 56 is arranged both in FIG. 5 and in FIG. 6 between the top arm 51*a* of the rigid C-beam 51 and the bottom arm 52*a* of the movable C-beam 52. A guard 59 is provided on the rear side of the supporting member. On the front side, on the other hand, such a guard, diverging from FIGS. 1–4, is not required. FIG. 6 differs from FIG. 5 only in that the adjusting board 64 and pins 65 are now arranged between the bottom arms 61*b* and 62*b* of the C-beams 61 and 62. In this case, the above-defined distance c can be virtually or completely reduced to zero.

Figure 8:
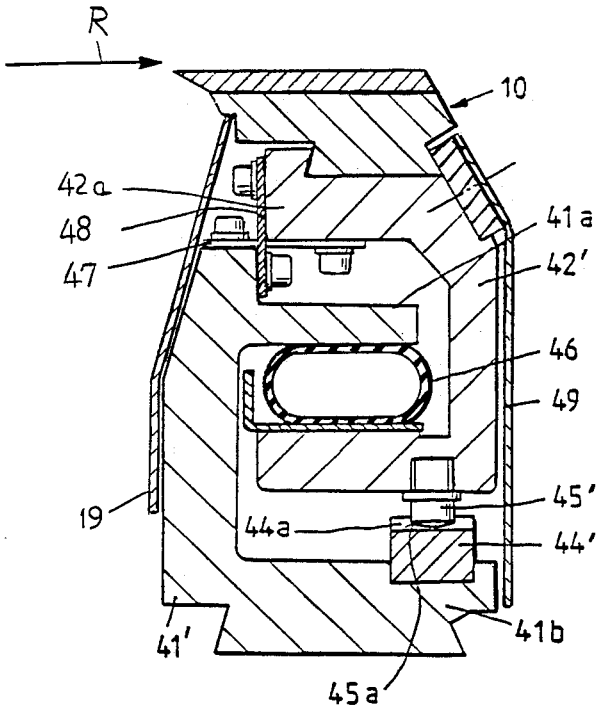
FIGS. 8 and 9 show another embodiment, with FIG. 8 being a cross-sectional view taken at line VIII—VIII of FIG. 9, and FIG. 9 being a view in the direction of wire travel (arrow R of FIG. 8).
Figure 9:
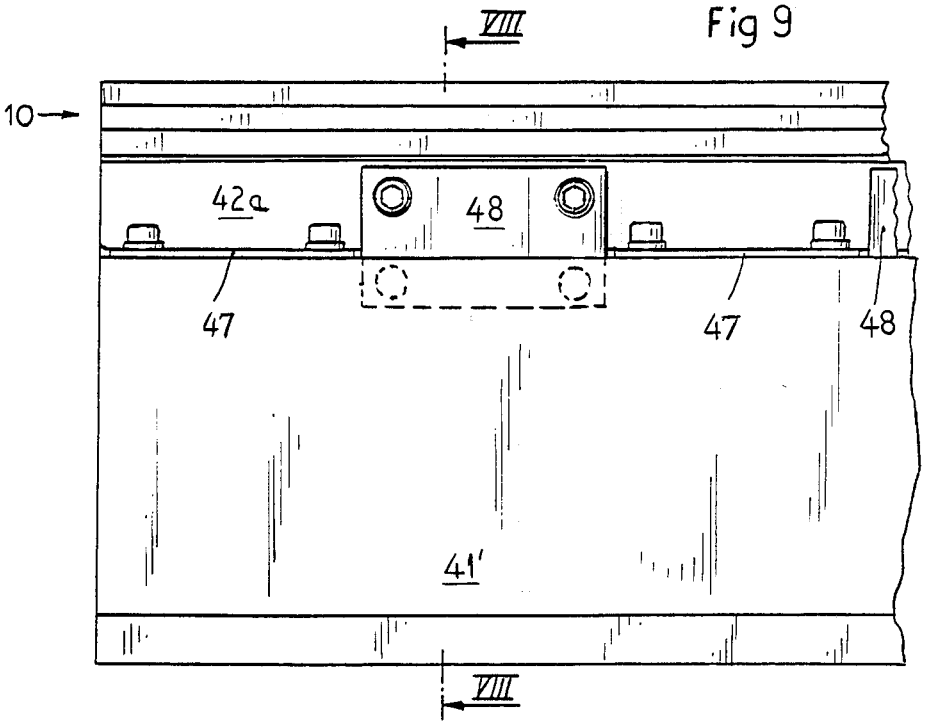

FIGS. 8 and 9 show an embodiment similar to that of FIG. 4, but which differs from FIG. 4 by a special configuration of the hinge connecting the two C-beams 41' and 42', and by a modified arrangement of the adjusting board 44'. In FIG. 4, the spring plate forming the hinge extends, as viewed in the cross-section, just like the spring plate 13 of FIG. 1, parallel to the direction of travel R of the wire belt. Furthermore, in the central area of the spring plate between the two fastening points, a relatively large length of the spring plate is provided, in which the spring plate contacts neither of the two C-beams 41 and 42. The purpose of this construction is to reduce the required exertion of force for adjustment of the angle of inclination. In FIGS. 8 and 9, the hinge is now formed by two different groups of spring plates, that is, by a first group of spring plates 47 which, viewed in the cross-section, extend as before parallel to the direction of wire travel, and by a second group of spring plates 48, which are arranged between the spring plates of the first group, and which, viewed in the cross-section, extend approximately normal to the direction of wire travel. All of the spring plates are again bolted to the stationary C-beam 41, and are also bolted to the movable C-beam 42. The leading guard 19 visible in FIG. 8 has been left out in FIG. 9.

In the spring plates 47 parallel to the direction of wire travel there prevail, as explained above, tensile forces. The other spring plates 48 are, on the other hand, subjected to pressure, triggered by the weight of the movable C-beam 42' complete with the head board 10, including the wire belt sliding over it and the fibrous suspension, as well as possibly by vertical, dynamic additional forces.

To again minimize the exertion of force for the adjustment of the angle of inclination of the drainage area, the spring plates 47 and 48 are fabricated from as thin steel sheet as possible. For this reason, however, it may become necessary to preclude the risk that the spring plates 48 arranged normal to the direction of wire travel buckle when subjected to pressure. Therefore, the two C-beams 41' and 42', viewed in the cross-section in accordance with FIG. 8, are shaped so that the spring plates 48 between the fastening points are supported as far as possible over their entire width by the C-beams 41' and 42'. In addition, a stiffening plate (not shown) may be inserted in the area of the top arm 42*a* of the movable C-beam 42' between each of the vertical spring plates 48 and the associated bolts.

The special hinge design shown in FIGS. 8 and 9 has the advantage that the position of the hinge axis (viewed in cross-section) in the point of intersection of the two spring plates 47 and 48 arranged normal to each other is more precise than in the other embodiments. Hence, the angle of inclination of the drainage area can be set or varied reproducibly with even higher accuracy. A contribution to this is also made by the fact that, as shown in FIG. 8, the adjusting board 44' and the pin 45' supported on it are arranged at a greater distance from the hinge axis (measured parallel to the direction of wire travel) than in FIG. 4.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A stationary supporting member for an endless drainage wire belt of a machine for the production of fibrous stock webs; wherein said wire belt travels in a travel direction; the stationary supporting member including:

(a) a head board extending transversely across the machine width; the head board being formed from non-flexible hard material; the head board having a doctor-like leading edge for extending to the wire belt; a substantially flat drainage area following the leading edge in the travel direction of the wire belt, the drainage area extending in a direction to define a small, variable angle of inclination with the direction of travel of the wire belt;

(b) a supporting structure for the head board comprising two beams with C-shaped cross-section as viewed along said direction of wire travel and which extend transversely across the machine width, one of the C-beams being secured rigidly in the machine and the other c-beam being movable with respect to the rigid beam;

each C-beam having two arms, including a top arm near the head board and a bottom arm further from the head board, the arms of the C-beams engaging in each other, wherein the top arm of the rigid C-beam is located between the arms of the movable C-beam while the bottom arm of the movable C-beam is located between the arms of the rigid C-beam, each arm having a topside and an underside;

the head board being secured only to the movable C-beam;

(c) a hinge element which extends substantially entirely across the supporting member for coupling the movable C-beam to the rigid C-beam;

said hinge element being secured to the rigid C-beam in the area underneath the leading edge of the head board and extending in the travel direction, and being secured to the underside of one arm of the movable C-beam;

(d) the C-beams having pairs of stop surfaces between them, at which the beams bear against each other, the pairs of stop surfaces being distributed over the cross machine length of the supporting member; each pair of stop surfaces comprising an adjustable stop surface;

(e) a clamping element between one arm of the rigid C-beam and an adjacent arm of the movable C-beam and extending across substantially the entire length of the supporting member and being operable for pressing the stop surfaces onto one another;

(f) an adjusting board defining the adjustable stop surfaces of the pairs of stop surfaces, the adjusting board extending longitudinally across the entire supporting member and being supported on and guided by the rigid C-beam to be slidable over the longitudinal extension of the adjusting board;

the adjusting board having a plurality of adjusting board surfaces distributed over its length, the adjusting board surfaces being inclined against the longitudinal direction and forming the adjustable stops surfaces;

the others of the pairs of stop surfaces being on the movable C-beam and the adjustable stop surfaces interacting with the corresponding paired stop surfaces on the movable C-beam for adjusting the angle of inclination of the C-beams with respect to each other.

2. The stationary supporting member of claim 1, wherein the hinge element comprises a plurality of hinge elements distributed across the entire supporting member.

3. The stationary supporting member of claim 1, wherein the clamping element comprises an inflatable hose for being selectively inflated for pressing the stop surfaces together.

4. The stationary supporting member of claim 1, wherein (a) the arms of the rigid C-beam extend in the direction of wire travel while the arms of the movable C-beam extend in the opposite direction;

(b) said hinge element being secured at a position shifted along the direction of wire travel to the underside of the top arm of the movable C-beam;

(c) the adjusting board being arranged between the top arm of the rigid C-beam and the bottom arm of the movable C-beam;

(d) the clamping element being arranged between the bottom arm of the rigid C-beam and the bottom arm of the movable C-beam.

5. The stationary supporting member of claim 1, wherein (a) the arms of the rigid C-beam extend in the direction of wire travel and the arms of the movable C-beam extend in the opposite direction;

(b) said hinge element being secured at a position shifted along the direction of wire travel to the underside of the top arm of the movable C-beam;

(c) the adjusting board being arranged between the top arm of the rigid C-beam and the top arm of the movable C-beam;

(d) the clamping element being arranged between the top arm of the rigid C-beam and the bottom arm of the movable C-beam.

6. The stationary supporting member of claim 1, wherein (a) the arms of the rigid C-beam extend in the direction of wire travel and the arms of the movable C-beam extend in the opposite direction;

(b) said hinge element being secured at a position shifted in the direction of wire travel to the underside of the top arm of the movable C-beam;

(c) the adjusting board being arranged between the bottom arm of the rigid C-beam and the bottom arm of the movable C-beam;

(d) the clamping element being arranged between the top arm of the rigid C-beam and the bottom arm of the movable C-beam.

7. The stationary supporting member of claim 1, wherein (a) the arms of the movable C-beam extend in the direction of wire travel and the arms of the rigid C-beam extend in the opposite direction;

(b) said hinge element being secured at a position shifted in the direction of wire travel to the underside of the bottom arm of the movable C-beam;

(c) the adjusting board being arranged between the two top arms of the rigid C-beam and of the movable C-beam;

(d) the clamping element being arranged between the top arm of the rigid C-beam and the bottom arm of the movable C-beam.

8. The stationary supporting member of claim 1, wherein (a) the arms of the movable C-beam extend in the direction of wire travel and the arms of the rigid C-beam extend in the opposite direction;

(b) said hinge element being secured at a position shifted in the direction of wire travel to the underside of the bottom arm of the movable C-beam;

(c) the adjusting board being arranged between the bottom arms of the rigid C-beam and of the movable C-beam;

(d) the clamping element being arranged between the top arm of the rigid C-beam and the bottom arm of the movable C-beam.

9. The stationary supporting member according to claim 2, wherein said hinge element, viewed in the cross section, extends substantially parallel to the direction of travel of the wire from the rigid C-beam to the movable C-beam.

10. The stationary supporting member of claim 2, wherein said hinge element viewed in cross section has at least one projection engaging in the rigid C-beam and at least one projection engaging in the movable C-beam and the hinge element is bolted by bolts at these projections to the C-beams.

11. The stationary supporting member of claim 10, wherein the projections are at different positions along the direction of wire travel.

12. The stationary supporting member of claim 10, wherein said hinge element is secured to the underside of the top arm of the movable C-beam.

13. The stationary supporting member of claim 12, wherein at least some of the heads of the bolts serving to secure the hinge element to the movable C-beam are shaped as stops and define the stop surfaces that interact with the inclined surfaces of the adjusting board.

14. The stationary supporting member of claim 1, wherein viewed in cross section, a plane is determined by the cooperating stop surfaces and the plan extends substantially parallel to the direction of wire travel.

15. The stationary supporting member of claim 1, wherein said hinge element has an axis through it, and viewed in cross section, a plane is determined by the cooperating stop surfaces and the plane runs at least close to the hinge axis.

16. The stationary supporting member of claim 15, wherein the plane determined by the cooperating stop surfaces is inclined against the direction of travel of the wire belt.

17. The stationary supporting member of claim 1, wherein each stop surface has an axis through it, and viewed in cross section, the axis of each stop surface is arranged in the center of the clamping element.

18. The stationary supporting member of claim 1, wherein the hinge is formed by a first group of spring plates which, viewed in cross section, extend parallel to the direction of wire travel, and by a second group of spring plates, which are arranged between the spring plates of the first group, and which, viewed in cross section, extend approximately normal to the direction of wire travel.

19. The stationary supporting member of claim 18, wherein viewed in cross section, the adjusting board and the cooperating stop surfaces are arranged offset against the center of the clamping element in the direction of wire travel.

20. In combination, a stationary supporting member according to claim 1 and an endless drainage wire belt for use in a machine for the production of fibrous stock webs, the wire belt being movable over the head board in the travel direction.

* * * * *